US005405195A

United States Patent [19]

Hobbs

[11] Patent Number: 5,405,195

[45] Date of Patent: Apr. 11, 1995

[54] AUTOMATIC RELEASE MECHANISM FOR TELESCOPING SLIDE ASSEMBLY

[75] Inventor: James D. Hobbs, Plainfield, Ind.

[73] Assignee: General Devices Co., Inc., Indianapolis, Ind.

[21] Appl. No.: 204,870

[22] Filed: Mar. 1, 1994

[51] Int. Cl.[6] ..... A47B 88/00

[52] U.S. Cl. ..... 312/334.46; 312/334.32; 312/334.38; 384/18

[58] Field of Search ..... 312/334.46, 334.8, 334.32, 312/334.47, 334.11, 334.38; 384/18; 403/109, 324, 328

[56] References Cited

U.S. PATENT DOCUMENTS

| | | | |
|---|---|---|---|
| 2,730,423 | 1/1956 | Mock | 312/334.46 |
| 2,731,321 | 1/1956 | Thompson | 312/334.46 |
| 2,765,208 | 10/1956 | Bush | 312/334.46 |
| 3,033,638 | 5/1962 | Tomlinson | 312/334.8 |
| 3,450,446 | 6/1969 | Fall et al. | 384/18 |
| 3,589,778 | 6/1971 | Olson . | |
| 3,801,166 | 4/1974 | York | 384/18 |
| 3,866,993 | 2/1975 | Dean et al. | 312/216 |
| 4,200,342 | 4/1980 | Fall | 384/18 |
| 4,272,139 | 6/1981 | Fler | 312/333 |
| 4,469,384 | 9/1984 | Fler et al. | 312/334.11 |
| 4,473,262 | 9/1984 | Staye . | |
| 4,560,212 | 12/1985 | Papp et al. | 384/18 |
| 4,600,255 | 7/1986 | Dubarko . | |
| 4,610,487 | 9/1986 | Delmege et al. | 384/18 |
| 4,749,242 | 6/1988 | Rechberg | 312/334.11 X |
| 4,872,734 | 10/1989 | Rechberg | 312/334.11 X |
| 4,988,214 | 1/1991 | Clement | 384/18 |
| 4,993,847 | 2/1991 | Hobbs | 384/18 X |
| 4,998,828 | 3/1991 | Hobbs | 384/18 |
| 5,033,805 | 7/1991 | Hobbs | 384/18 |
| 5,085,523 | 2/1992 | Hobbs | 384/18 X |
| 5,181,782 | 6/1993 | Wojcik | 384/18 |
| 5,211,461 | 5/1993 | Teufel et al. | 312/334.8 |

FOREIGN PATENT DOCUMENTS

| | | |
|---|---|---|
| 838360 | 5/1952 | Germany . |
| 845173 | 7/1952 | Germany . |
| 3930713 | 3/1991 | Germany . |

*Primary Examiner*—José V. Chen
*Assistant Examiner*—Rodney B. White
*Attorney, Agent, or Firm*—Barnes & Thornburg

[57] ABSTRACT

A telescoping slide assembly is provided for moving a load between a fully retracted position and a fully extended position. The telescoping slide assembly includes a load-carrying slide member and an intermediate slide member and each slide member is formed to include a locking aperture. The telescoping slide assembly further includes means for locking the load-carrying and intermediate slide members to their fully retracted positions. The locking means includes a locking pin and means for yieldably biasing the locking pin to a slide-locking position passing through the locking aperture of each slide member when the slide members occupy their fully retracted positions.

30 Claims, 4 Drawing Sheets

AUTOMATIC RELEASE MECHANISM FOR TELESCOPING SLIDE ASSEMBLY

BACKGROUND AND SUMMARY OF THE INVENTION

The present invention relates to telescoping slide assemblies, and particularly to a slide assembly having three slide members and lock mechanisms for locking the slide members in various retracted and extended positions. More particularly, the present invention relates to a telescoping slide assembly that contains automatic release mechanisms for controlling unlocking of the slide members during telescoping movement of the slide members between extended and retracted positions.

A conventional telescoping slide assembly typically includes a stationary slide member, a load-carrying slide member, and an intermediate slide member. The intermediate slide member is positioned and configured to move the load-carrying slide member toward and away from the stationary slide member. Typically, a pair of telescoping slide assemblies are positioned in side-by-side spaced-apart parallel relation so that either a load-carrying platform or one or more pieces of equipment can be carried on the two side-by-side load-carrying slide members. It is also common to use a pair of telescoping slide assemblies to support a cabinet drawer between a retracted position inside the cabinet and an extended position outside the cabinet.

The stationary slide member is typically mounted to a fixed frame to anchor the slide assembly. The frame could be a cabinet, a truck bed, or any other suitable platform. For example, it is known to use telescoping slide assemblies to slide heavy pieces of equipment into and out of a truck bed.

Various kinds of equipment or loads can be anchored to the movable load-carrying slide members so that such loads can be moved easily relative to the truck bed or the like during telescoping extension and retraction of the intermediate and load-carrying slide members in each slide assembly relative to the stationary slide members that are anchored to the truck bed. Typically, a telescoping slide assembly is extended and retracted manually by an operator and thus must be capable of moving heavy loads easily and quickly under the control of an operator during loading of equipment onto the truck and unloading of equipment from the truck.

It is known to provide locking interconnections between each of the three slide members so that extension or retraction of the slide members relative to each other can be prevented. This allows a drawer or equipment rack mounted on a pair of telescoping slide assemblies to be extended outward in the extending direction and locked to maintain a desired extended position. Since these locking interconnections must generally be manually engaged and disengaged, separate manual unlocking actions are required before such a drawer or equipment can be extended. The use of a locking mechanism to prevent relative movement of two sliding tracks until manual release of the locking mechanism is known. See, for example, U.S. Pat. No. 4,200,342 to Fall.

Typically, as the telescoping slide assemblies extend to move the equipment or load from the retracted position, the slide members lock automatically in a partly extended position. An operator initiates the extension process by manually actuating a release mechanism to allow the slide members to extend relative to one another. However, friction between the load-carrying slide member and the intermediate slide member will sometimes cause these two slide members to "stick" together and therefore move together as a unit relative to the stationary slide member toward an extended position. In some instances, the operator will have let go of the release mechanism prematurely and therefore will not have actuated the release mechanism fully to unlock the load-carrying slide member so that it is free to move relative to the intermediate slide member. In such a circumstance, when the intermediate slide member reaches its fully extended position and is locked to the stationary slide member, the load-carrying slide member is still locked to the now immobile intermediate slide member and the slide assembly is stopped prematurely in a partly extended position.

In order to continue moving the load to the fully extended position, the operator must manually actuate the release mechanism a second time to allow the load-carrying slide member to extend to its fully extended position relative to the fixed intermediate slide member. In many applications, the need for a second manual actuation of the release mechanism is a nuisance. This problem is especially aggravating in cases wherein an operator is using the telescoping slide assembly to move a heavy unit and must manually actuate the release mechanism twice to move the slide members in the slide assembly to their fully extended positions. Therefore, telescoping slide assemblies that provide a release mechanism for allowing the slide members to fully extend without stopping at a partly extended position would be an improvement over conventional slide assemblies.

Another problem facing some users of telescoping slide assemblies is inadvertent damage to a locking pin in the release mechanism during movement of the load-carrying and intermediate slide members relative to the stationary slide member toward their fully retracted positions. Such damage can sometimes occur if the operator pushes the load-carrying and intermediate slide members toward their fully retracted positions without realizing that those two slide members are still locked together to move as a unit. This problem is known to happen when the operator has the slide assembly open for servicing a unit but did not need to extend the slide assembly to its fully extended position to gain access to that part of the unit needing repair or attention.

Unless the operator realizes that the load-carrying and intermediate slide members are locked together as they are moved toward their fully retracted positions and then manually actuates the release mechanism at the proper time to enable the load-carrying slide member to continue moving toward its fully retracted position once the intermediate slide member reaches its fully retracted position, it is possible that the locking pin in the release mechanism will be urged by the load-carrying slide member to strike sharply against the intermediate slide causing the locking pin to break or deform, thus disabling the release mechanism. What is needed is a mechanism for automatically unlocking the load-carrying and intermediate slide members as they move toward fully retracted positions under the circumstances just described to prevent unwanted damage to the locking pin.

According to the present invention, a telescoping slide assembly is provided for moving a load between a fully retracted position and a fully extended position. The telescoping slide assembly includes a load-carrying slide member and an intermediate slide member and each slide member is formed to include a locking aperture. The telescoping slide assembly further includes means for locking the load-carrying and intermediate slide members to their fully retracted positions. The locking means includes a locking pin and means for yieldably biasing the locking pin to a slide-locking position passing through the locking aperture of each slide member when the slide members occupy their fully retracted positions.

The telescoping slide assembly also includes actuator means for withdrawing the locking pin from either the locking aperture in the stationary slide member or the locking apertures in both of the intermediate and stationary slide members to allow an operator to move the intermediate and load-carrying slide members toward their fully extended positions. Ramp means is provided in the locking aperture formed in the intermediate slide member for automatically camming a locking pin passing through only the locking apertures formed in the load-carrying and stationary slide members to a raised position out of the locking aperture formed in the intermediate slide member without operating the actuator means so that the load-carrying slide member is free to move relative to the intermediate slide member toward its fully extended position.

In preferred embodiments, a first bushing is mounted in the locking aperture formed in the intermediate slide member and that first bushing provides the ramp means. Illustratively, the first bushing includes an aperture receiving the locking pin and a conical locking pin-ramping surface communicating with the aperture and facing toward the load-carrying slide member.

To extend the telescoping slide assembly, the operator first uses the actuator means to withdraw the locking pin from the locking aperture formed in the stationary slide member and then moves the load-carrying slide member toward its fully extended position. During such movement, the locking pin will engage the conical surface in the first bushing and be ramped automatically to a raised position disengaging the locking aperture formed in the intermediate slide member. Now, the load-carrying slide member is unlocked from the intermediate slide member and is free to move to its fully extended position.

Illustratively, the intermediate slide member is also formed to include a second locking aperture near the outermost end of the intermediate slide member and a second bushing is mounted in this second locking aperture. This second bushing is configured to cam the locking pin out of the second locking aperture during certain operating conditions to prevent breakage or deformation of the locking pin.

The second bushing includes another aperture for receiving the locking pin and a conical locking pin-camming surface communicating with the aperture and facing toward the load-carrying slide member. The locking pin will, in certain circumstances, engage the conical surface in the second bushing and be cammed automatically to a raised position disengaging the second locking aperture formed in the intermediate slide member as the load-carrying slide moves toward its retracted position.

The camming action taking place in the second bushing protects the locking pin from being broken or deformed during retraction of the slide assembly in the event that the operator fails to lift the locking pin manually to its raised position using the actuator means at the start of a slide-retracting sequence. As noted above, this circumstance might occur in the event that an operator does not need to operate the actuator mechanism and raise the locking pin to unlock the locked connection between the load-carrying and intermediate slide member to begin the slide-retracting sequence because the slide assembly was not previously pulled to its fully extended position wherein the intermediate slide member would have been locked to the stationary slide member and the load-carrying slide member would have been locked to the intermediate slide member. Thus, the cam means in the second bushing functions to protect the locking pin in circumstances where a slide-retracting sequence begins and the intermediate slide member is not locked to the stationary slide member but is locked to the load-carrying slide member.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figures 1, 2, 3, 4:
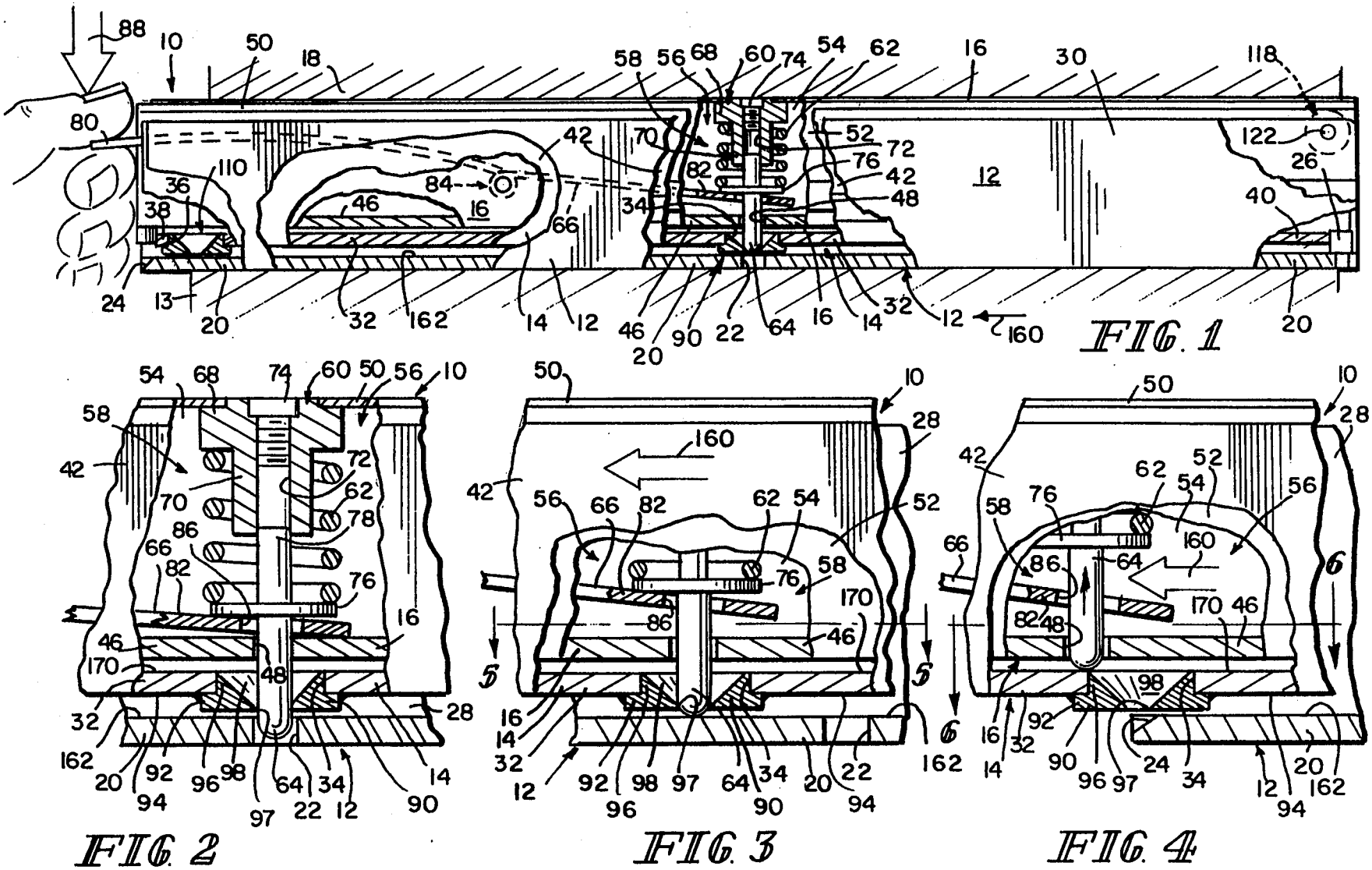
FIG. 1 is a side elevation view of a telescoping slide assembly in accordance with the present invention, with portions broken away, showing a locking pin raised by an operator-controlled actuator lever to lie adjacent to a conical ramp surface in a first bushing mounted in an intermediate slide assembly when the assembly is in its fully retracted position.
FIG. 2 is an enlarged view similar to FIG. 1 showing the locking pin passing through locking apertures formed in the load-carrying, intermediate, and stationary slide members.
FIG. 3 is a view similar to FIG. 2 after the locking pin has been raised manually to the position shown in FIG. 1 and then moved to the left in response to movement of the load-carrying and intermediate slide members toward their fully extended positions.
FIG. 4 is a view similar to FIGS. 2 and 3 after the locking pin has been raised by the conical ramp surface in the first bushing to a higher vertical position during movement of the load-carrying slide member toward its fully extended position.

The telescoping slide assembly 10 illustrated in FIG. 1 includes three nested and interconnected slide members 12, 14, and 16. A stationary slide member 12 is configured to be mounted on a base 13 as shown in FIG. 1. An intermediate slide member 14 is nested in and capable of back and forth motion relative to the stationary slide member 12. A load-carrying slide member 16 is configured to support a piece of equipment 18 to be moved as shown, for example, in FIGS. 1, 7, and 9. The load-carrying slide member 16 is nested in and capable of back and forth motion relative to the intermediate slide member 14.

The stationary slide member 12 includes a bottom wall 20 that is formed to include a locking aperture 22 midway along its length. A beveled edge 24 is formed at the leading end of the stationary slide member 12 and a stop member 26 is mounted on the trailing end of the stationary slide member 12. The beveled edge 24 functions to control the operation of a locking mechanism mounted on the load-carrying slide member 16 to a fully retracted position as shown in FIG. 1. The stop member 26 is positioned on the stationary slide member 12 to establish the fully retracted position of the intermediate slide member 14 as shown in FIG. 1. The stationary slide member 12 also includes spaced-apart first and second upstanding side walls 28, 30 as shown, for example, in FIGS. 8 and 10.

Figure 7:
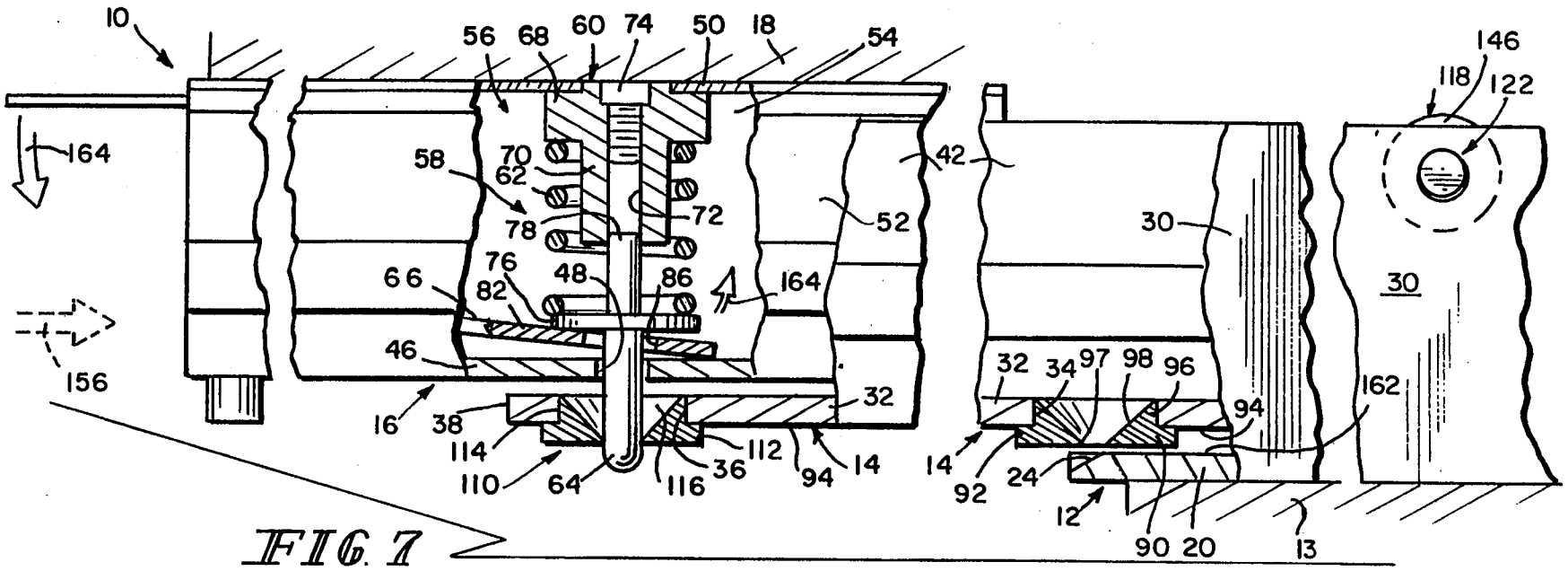
FIG. 7 is an enlarged side elevation view similar to FIG. 1 of the telescoping slide assembly in its fully extended position showing the vertical locking pin in a position passing through a second bushing mounted in the intermediate slide member and locking the load-carrying slide member to the intermediate slide member and a horizontal locking pin in a position locking the intermediate slide member to the stationary slide member prior to actuation of a pivotable lever to release the locking pin.

The intermediate slide member 14 includes a bottom wall 32 that is formed to include spaced-apart first and second locking apertures 34, 36 as shown, for example, in FIGS. 1 and 7. The first locking aperture 34 is positioned midway along the length of the intermediate slide member 14 to line up above the locking aperture 22 formed in the bottom wall 20 of the underlying stationary slide member 12 once the intermediate slide member 14 reaches the fully retracted position shown in FIG. 1. The second locking aperture 36 is positioned to lie in close proximity to a leading end 38 of the intermediate slide member 14. The intermediate slide member 14 includes a trailing end 40 arranged to engage stop member 26 as shown in FIG. 1 and spaced-apart first and second upstanding side walls 42, 44 as appended to bottom wall 32.

The load-carrying slide member 16 includes a bottom wall 46 that is formed to include a locking aperture 48 midway along the length of the load-carrying slide member 16 as shown in FIG. 1. The load-carrying slide member 16 also includes a top wall 50 and spaced-apart first and second upstanding side walls 52, 54 interconnecting the top and bottom walls 50, 46 to define an elongated interior region 56 inside the load-carrying slide member 16.

A slide-locking mechanism 58 is mounted to the top wall 50 of load-carrying slide member 16 and arranged to lie in the interior region 56 and move back and forth with the load-carrying slide member 16 as shown in FIG. 1. The slide-locking mechanism 58 includes a base 60, a spring 62, a locking pin 64, and an actuator lever 66. The base 60 is formed to include a foundation 68 appended to the top wall 50 of the load-carrying slide member 16, a guide post 70, and a guide aperture 72 passing through foundation 68 and guide post 70 and receiving mounting bolt 74 and locking pin 64. An annular lift member 76 is appended to the midsection of locking pin 64 and an upper end 78 of the locking pin 64 is received for sliding movement in the guide aperture 72 as shown, for example, in FIGS. 1, 2, 7, and 13.

As shown best in FIG. 2, the spring 62 in slide-locking mechanism 58 is positioned to urge the locking pin 64 through the locking apertures 48, 34, 22 formed in the load-carrying, intermediate, and stationary slide members 16, 14, 12, respectively, to establish a locked connection between slide members 12, 14, 16 in the fully retracted position of the telescoping slide assembly 10 shown in FIG. 1. An upper end of coiled compression spring 62 engages foundation 68 and surrounds guide post 70 and a lower end of spring 62 engages annular lift member 76 as shown best in FIG. 2.

Actuator lever 66 is operable to withdraw the locking pin 64 from the locking apertures formed in the slide members against the downward biasing force generated by coiled compression spring 62. Actuator lever 66 includes a grip handle 80 at its outer end, a lift handle 82 at its inner end, and pivot means 84 at a middle portion for mounting the lever 66 for pivotable movement in the interior region 56 of the load-carrying slide member 16. The lift handle 82 is formed to include a locking pin-receiving aperture 86 as shown, for example, in FIGS. 1 and 2. In use, an operator can push down on grip handle 80 in direction 88 as shown in FIG. 1 to lift locking pin 64 in an opposite upward direction against spring 62.

A first bushing 90 is mounted in the first locking aperture 34 formed in the intermediate slide member 14 and configured to ramp the locking pin 64 automatically from a first lowered position shown in FIG. 3 to a second raised position shown in FIG. 4 during outward movement of the load-carrying slide member 16 toward its fully extended position. The first bushing 90 includes a head portion 92 engaging the bottom side 94 of the intermediate slide member 14 and a smaller diameter body portion 96 lying in the first locking aperture 34 formed in the intermediate slide member 14. The first bushing 90 also includes a conical surface 98 facing toward the load-carrying slide member 16 and defining a locking pin-camming ramp. The conical surface 98 has a larger diameter top opening adjacent to the load-carrying slide member 16 and a smaller diameter bottom opening 97 adjacent to the underlying stationary slide member 12. Weldment, adhesive, or any suitable attachment means can be used to retain the first bushing 90 in place in the first intermediate slide member locking aperture 34.

Figures 11, 12, 13:
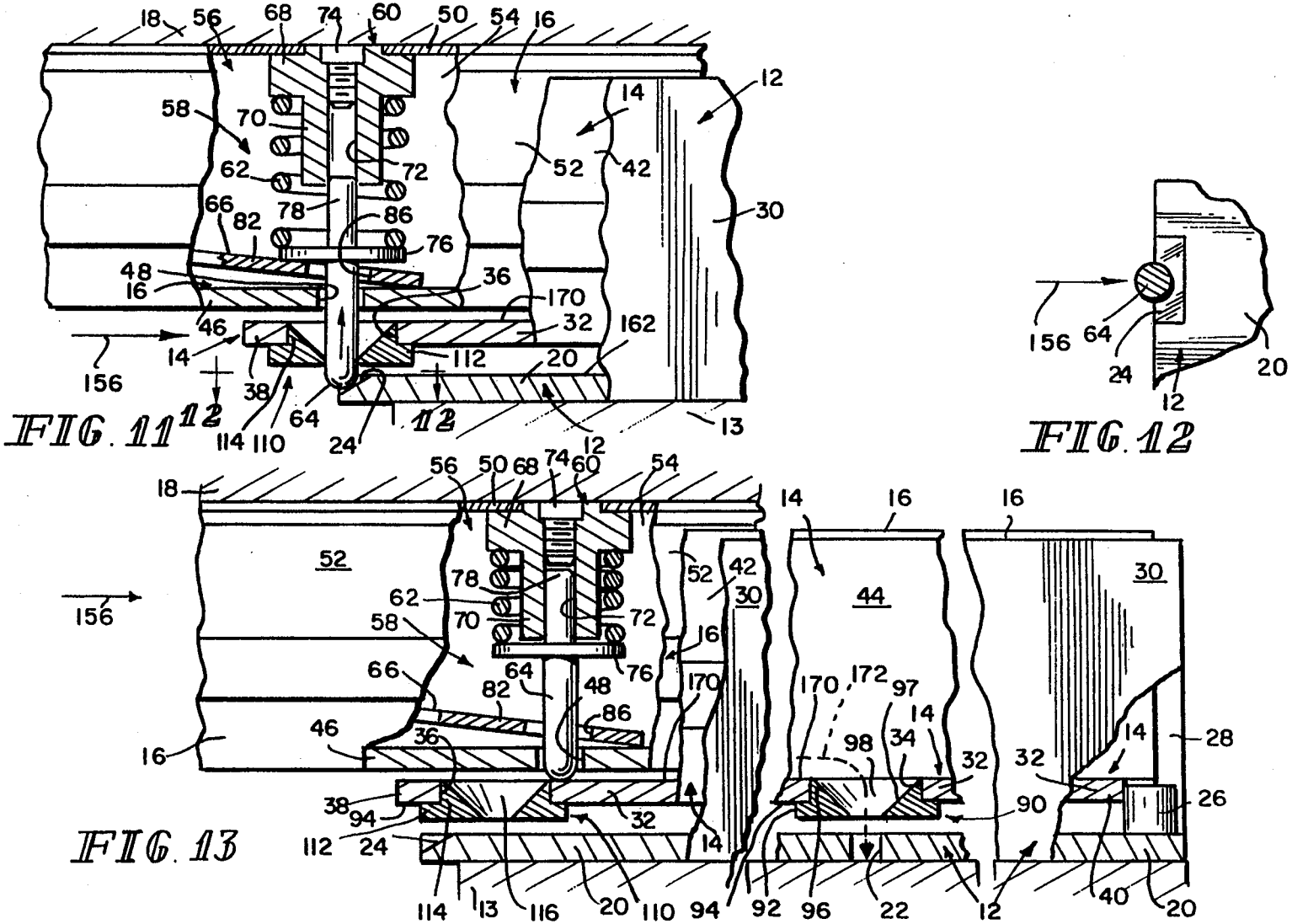
FIG. 11 is an enlarged side elevational view of the telescoping slide assembly of FIG. 9, with portions broken away, showing the locking pin passing through the second bushing and engaging a beveled edge on the stationary slide member during movement of the load-carrying and stationary slide members as a unit toward their fully retracted positions.
FIG. 12 is a view taken along line 12—12 of FIG. 11 showing the locking pin engaging the beveled edge on the stationary slide member.
FIG. 13 is a view similar to FIG. 12 showing the locking pin after it has been cammed to a raised position by the conical surface in the second bushing and before the locking pin is biased into the aperture formed in the first bushing while the intermediate slide member occupies its full retracted position engaging a stop member mounted to the right end of the stationary slide member.

A second bushing 110 is mounted in the second locking aperture 36 formed in the intermediate slide member 14 and configured to ramp the locking pin 64 automatically from a first lowered position (a little higher in direction 99 than the position shown in FIG. 11) to a second raised position shown in FIG. 13 under certain circumstances shown in FIGS. 9–13 during inward movement of the load-carrying slide member 16 toward its fully retracted position. The second bushing 110 is shown in FIGS. 1 and 7 and includes a head portion 112 engaging the bottom side 94 of the intermediate slide member 14 and a smaller diameter body portion 114 lying in the second locking aperture 36 formed in the intermediate slide member 14. The second bushing 110 also includes a conical surface 116 facing toward the load-carrying slide member 16 and defining a locking pin-camming ramp. The conical surface 116 has a large diameter top opening adjacent to the load-carrying slide member 16 and a smaller diameter bottom opening adjacent to the underlying stationary slide member 12. Weldment, adhesive, or any suitable attachment means can be used to retain the second bushing 110 in place in the second intermediate slide member locking aperture 36.

Figure 8:
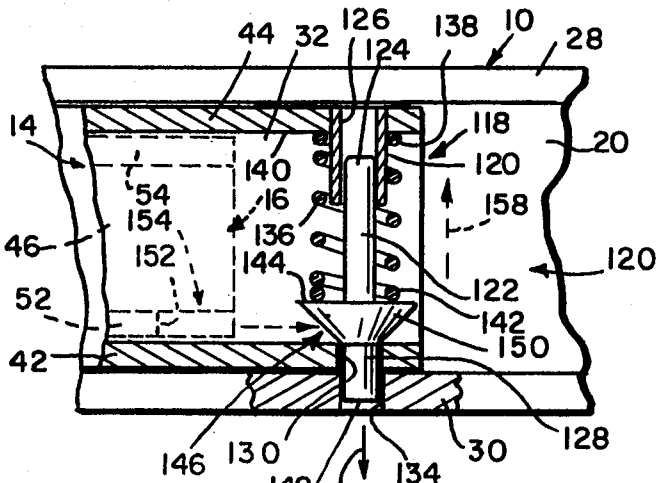
FIG. 8 is a view taken along line 8—8 of FIG. 7 showing the horizontal locking pin in a position locking the intermediate slide member to the stationary slide member.

As shown in FIGS. 1, 7, and 8, a locking mechanism 118 is provided for locking the intermediate slide member 14 to the stationary slide member 12 when the intermediate slide member 14 reaches its fully extended position shown in FIGS. 7 and 8. Illustratively, the locking mechanism 118 moves back and forth in horizontal directions between locked and unlocked positions while the slide-locking mechanism 58 moves up and down in vertical directions between locked and unlocked positions. Locking mechanism 118 includes a horizontal guide post 120 appended to the second side wall 44 of intermediate slide member 14 and a horizontal locking pin 122. Horizontal locking pin 122 includes an inner end 124 mounted for sliding movement in a guide aperture 126 formed in the horizontal guide post 120 and an outer end 128 for sliding in a guide aperture 130 formed in the first side wall 42 of the intermediate slide member 14 and moving into or out of a locking aperture 134 formed in the first side wall 28 of the stationary slide member 12.

As shown in FIG. 8, the locking mechanism 118 also includes a spring 136 for urging the horizontal locking pin 122 outwardly in direction 137 into the locking aperture 134 to lock the intermediate slide member 14 to the stationary slide member 12 once the intermediate slide member 14 reaches its fully extended position. One end 138 of coiled compression spring 136 engages an inner surface 140 of the second side wall 44 and surrounds horizontal guide post 120 and the other end 142 of spring 136 engages an annular flat wall 144 of a conical cam member 146. The conical cam member 146 is appended to the horizontal locking pin 122 and set back a short distance from the outer tip 148 of horizontal locking pin 122. The conical cam member 146 includes a conical ramp 150 that is positioned to be engaged by a drive wall 152 lying in a slot 154 formed in the first side wall 52 of the load-carrying member 16 during inward movement of the load-carrying slide member 16 in direction 156 toward its fully retracted position. Such engagement can operate to move the horizontal locking pin 122 in direction 158 against the biasing force of spring 136 to break the locked connection between the intermediate and stationary slide members 14, 12. In effect, the horizontal locking pin 122 is moved automatically by camming engagement with the load-carrying slide member 16 to the unlocked position shown in FIG. 10.

Operation of vertical slide-locking mechanism 58 and horizontal locking mechanism 118 during normal movement of load-carrying slide member 16 from a fully retracted position (FIG. 1) to a fully extended position (FIG. 7) is shown in FIGS. 1–8. Initially, the vertical locking pin 64 is biased by spring 62 to a slide locking position passing through locking aperture 48 in load-carrying slide member 16, bottom opening 97 in first bushing 90 (and locking aperture 34 in intermediate slide member 14), and locking aperture 22 in stationary slide member 12 to establish a releasable locked connection between the three slide members 12, 14, and 16.

The locked connection between the intermediate and stationary slide members 14, 12 is released by pivoting the actuator lever 66 as shown in FIG. 1 to withdraw the lower end of locking pin 64 from the locking aperture 22 in the stationary slide member 12. The load-carrying and intermediate slide members 16, 14 are now free to move as a unit to the left in direction 160 as shown in FIGS. 1 and 3. Illustratively, the locking pin 64 is raised to the position shown in FIG. 1 by an operator pushing downwardly in direction 88 on the grip handle 80 to pivot actuator lever 66 about pivot 84 enough to raise lift handle 82 on actuator lever 66 upwardly against the overlying annular lift member 76 appended to the vertical locking pin 64. This lifting action causes the annular lift member 76 to move upwardly toward base 60 so as to compress spring 62 and raise locking pin 64.

Figure 5:
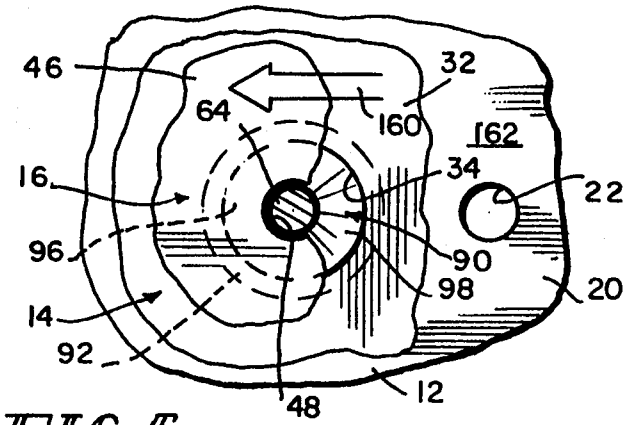
FIG. 5 is a view taken along line 5—5 of FIG. 3 showing the locking pin in the central aperture formed in the first bushing at the lowermost edge of the conical surface.
Figure 6:
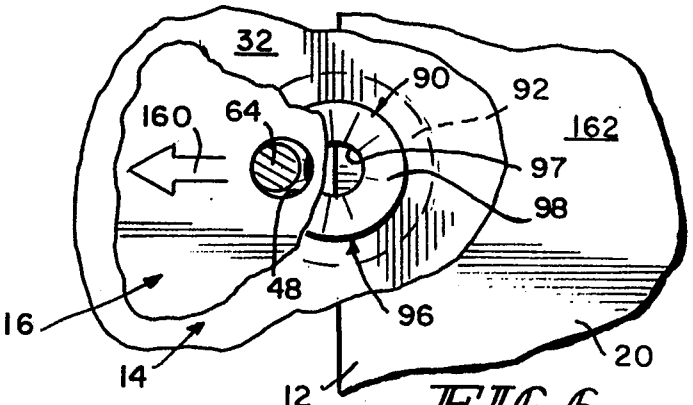
FIG. 6 is a view taken along line 6—6 of FIG. 4 showing the locking pin ramping on the conical surface in the first bushing.

Once raised by the actuator lever 66, the lower end of locking pin 64 is biased by spring into engagement with an upwardly facing surface 162 on bottom wall 20 of stationary slide member 12 as shown in FIG. 2. The downwardly biased locking pin 64 glides along the upwardly facing surface 162 of stationary slide member 12 as the load-carrying and intermediate slide member unit moves to the left in direction 160 toward a fully extended position as shown in FIGS. 2 and 5.

The lower end of locking pin 64 is raised automatically (without using actuator lever 66) from a first position shown in FIG. 3 to a second position shown in FIG. 4 by ramping on the conical surface 98 provided in first bushing 90 during movement of load-carrying slide member 16 to the left in direction 160 relative to intermediate slide member 14. Such relative movement is possible once the intermediate slide member 14 is locked in a fully extended position to the stationary slide member 12 by automatic actuation of the horizontal locking mechanism 118 as shown in FIGS. 7 and 8.

Once the locking pin 64 has been raised automatically to the second position shown in FIG. 4, the operator can continue to pull the load-carrying slide member 16 outwardly in direction 160 until the spring-biased vertical locking pin 64 snaps downwardly into a slide locking position in the second bushing 110 as shown in FIG. 7. Now, the load-carrying slide member 16 has reached its fully extended position and has been locked to the fixed and fully extended intermediate slide member 14. Advantageously, because of the locking pin-ramping action provided by first bushing 90, an operator need only operate the actuator lever 66 once (at the beginning of a slide extension cycle) to move the load-carrying and intermediate slide members 16, 14 to their fully extended positions. It will be understood that it is within the scope of the present invention to ramp the locking pin to its raised position using only suitable ramping means. Advantageously, a bushing having a conical ramp is simple to manufacture and install.

To retract the telescoping slide assembly 10, an operator need only pivot actuator lever 66 once in direction 164 to withdraw the vertical locking pin 64 from the second bushing 110 and push the load-carrying slide member 16 to the right in direction 156. The locked connection between the intermediate and stationary slide members 14, 12 will be released (as suggested in FIG. 8) by engagement of a drive wall 152 in a slot 154 formed in intermediate slide member side wall 52 and a conical ramp 150 included in locking mechanism 118. Once released, the horizontal locking pin 122 moves in direction 158 to a position withdrawn from the locking aperture 134 in stationary slide member side wall 28 as shown, for example, in FIG. 10.

Advantageously, the telescoping slide assembly 10 is operable in the manner described above to allow the slide members 14, 16 to extend fully without stopping at a partly extended position. It is necessary to operate a release actuator lever or the like only at the beginning of each slide-extending sequence. The ramp means provided, for example, in the first bushing 90 makes it unnecessary for an operator to use actuator lever 66 a second time to release the locked connection between the load-carrying and intermediate slide members 16, 14 during extension of the load-carrying slide member 16.

Figure 10:
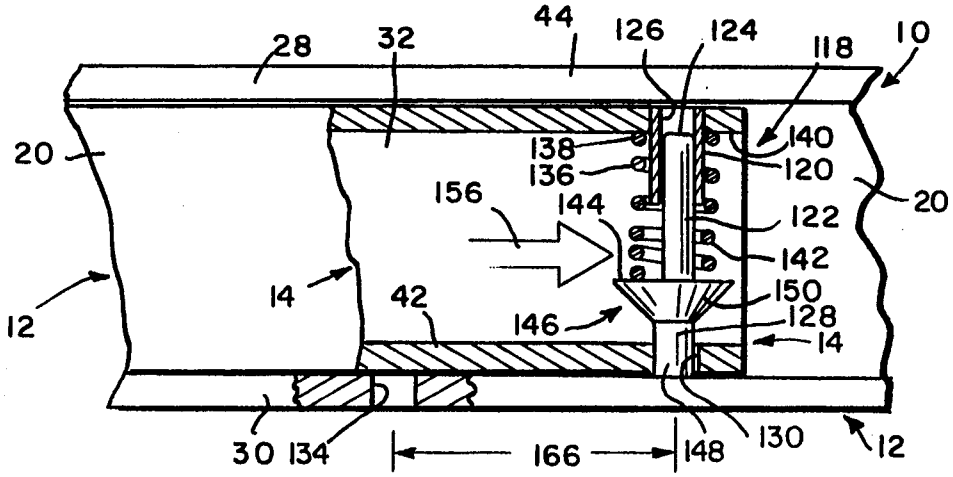
FIG. 10 is a transverse horizontal sectional view taken along lines 10—10 of FIG. 9 showing the horizontal locking pin in an unlocked disengaged position.
Figure 9:
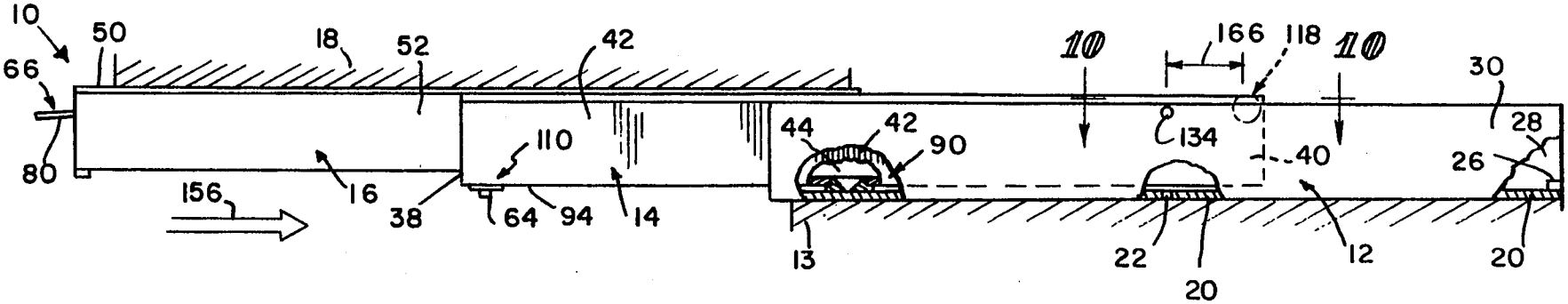
FIG. 9 is a side elevational view of the telescoping slide assembly of FIG. 1 showing a situation where the load-carrying slide member is locked to the intermediate slide member before the intermediate slide member has been extended to its fully extended position and locked to the stationary slide member and the load-carrying and intermediate slide members are just beginning to move to the right toward their fully retracted positions.

Occasionally, a situation of the type illustrated in FIGS. 9 and 10 may develop. As shown in FIG. 9, the load-carrying slide member 16 is locked to the intermediate slide member 14 by engagement of vertical locking pin 64 in first bushing 110. However, the intermediate slide member 14 has not been moved to its fully extended position relative to the stationary slide member 12. This means that the locking mechanism 118 lies a distance 166 away from locking engagement with the side locking aperture 134 formed in the stationary slide member 12. The only way to lock the intermediate slide member 14 to the stationary slide member 12 would be to move the intermediate slide member 14 distance 166 to the left. As noted above, this circumstance might occur in the event that an operator does not need to operate the actuator mechanism 66 and raise the locking pin 64 to unlock the locked connection between the load-carrying and intermediate slide members 16, 14 to begin the slide-retracting sequence because the slide assembly 10 was not previously pulled to its fully extended position (FIG. 7) wherein the intermediate slide member 14 would have been locked to the stationary slide member 12 and the load-carrying slide member 16 would have been locked to the intermediate slide member 14.

One problem facing some users of conventional telescoping slide assemblies is inadvertent damage to a locking pin in the locking mechanism during movement of the load-carrying and intermediate slide members as a unit relative to the stationary slide member toward their fully retracted positions. Such damage can sometimes occur if the operator pushes the load-carrying and intermediate slide members toward their fully retracted positions without realizing that those two slide members are still locked together to move as a unit as shown in FIG. 9. This problem is known to happen when the operator has a slide assembly open for servicing a unit as shown, for example, in FIGS. 9 and 10, but did not need to extend the slide assembly 10 to its fully extended position to gain access to that part of the unit mounted on the slide assembly 10 and in need of repair or attention.

Unless the operator realizes that the load-carrying and intermediate slide members are locked together (as shown in FIG. 9) as they are moved together as a unit toward their fully retracted positions and then manually actuates a release mechanism (like actuator 66) at the proper time to enable the load-carrying slide member to continue moving toward its fully retracted position once the intermediate slide member reaches its fully retracted position, it is possible that the locking pin in the locking mechanism will be urged by the load-carrying slide member to strike sharply against the intermediate slide causing the locking pin to break or deform, thus disabling the release mechanism. The telescoping slide assembly 10 is configured to solve such a problem.

As shown in FIGS. 11 and 13, the second bushing 110 is configured to provide a mechanism for automatically unlocking the load-carrying and intermediate slide members as they move toward fully retracted positions under the circumstances just described to prevent unwanted damage to the vertical locking pin 64. In use, the load-carrying and intermediate slide members 16, 14 are moved as a unit by an operator to the right in direction 156 until the lower end of vertical locking pin 64 engages the beveled edge 24 on the leading end of stationary slide member 12. Once the trailing end 40 of intermediate slide member 14 engages the stop member 26, continued inward movement of intermediate slide member 14 in direction 156 will be blocked. The intermediate slide member 14 has now reached its fully retracted position.

The beveled edge 24 on stationary slide member 12 functions to raise the lower end of the spring-biased vertical locking pin 64 from the position shown in FIG. 1 to a raised position engaging the upwardly facing surface 162 of the bottom wall 20 of the stationary slide member 12. Continued inward movement of load-carrying slide member 16 to the right in direction 156 relative to the stopped intermediate slide member 14 will cause the lower end of the vertical locking pin 64 to be cammed on the conical surface 116 provided in second bushing 110 from the first position on the upwardly facing surface 162 on the bottom wall 20 of the stationary slide member 12 to a raised second position on an upwardly facing surface 170 of the bottom wall 32 of the intermediate slide member 14. Thus, the cam means provided, for example, in the second bushing 110 functions to protect the locking pin 64 in circumstances where a slide-retracting sequence begins and the intermediate slide member 14 is not locked to the stationary slide member 12.

This automatic camming action advantageously minimizes any breakage or deformation of vertical locking pin 64 that might otherwise occur upon engagement of a moving locking pin 64 against a stopped intermediate slide member 14 during movement of load-carrying and intermediate slide member 16, 14 from a partly extended position such as shown in FIGS. 9 and 10 to a fully retracted position. As shown in FIG. 13, continued movement of load-carrying slide member 16 will cause the spring-biased vertical locking member 64 to glide along an upwardly facing surface 170 until it follows dotted line path 172 and snaps into a locking position in the first bushing 90 and the locking aperture 22 in the stationary slide member 12.

Although the invention has been described in detail with reference to certain preferred embodiments, variations and modifications exist within the scope and spirit of the invention as described and defined in the following claims.

I claim:

1. A telescoping slide assembly comprising interconnected load-carrying, intermediate, and stationary slide members movable relative to one another to extend and retract the load-carrying and intermediate slide members relative to the stationary slide member between fully extended and retracted positions, each slide member being formed to include a locking aperture, means for locking the load-carrying and intermediate slide members to the stationary slide member upon movement of the load-carrying and intermediate slide members to their fully retracted positions, the locking means including a locking pin and means for yieldably biasing the locking pin to a slide-locking position passing simultaneously through the locking aperture formed in each slide member upon movement of the load-carrying and intermediate slide members to their fully retracted positions so that the load-carrying and intermediate slide members are retained in their fully retracted positions, and a bushing mounted in the locking aperture formed in the intermediate slide member, the bushing being formed to include aperture means for slidably receiving the locking pin upon movement of the intermediate slide member to its fully retracted position and an inclined locking pin-camming ramp communicating with the aperture means and facing toward the load-carrying slide member.

2. The telescoping slide assembly of claim 1, wherein the bushing includes a conical surface defining the inclined locking pin-camming ramp.

3. The telescoping slide assembly of claim 2, wherein the intermediate slide includes a bottom wall having a bottom side facing toward the stationary slide member and a top side facing toward the load-carrying slide member, the bottom wall is formed to include the locking aperture, and the bushing further includes a head portion engaging the bottom side and a body portion lying in the locking aperture to position an outer edge of the conical surface adjacent to and coextensive with the top side of the bottom wall.

4. The telescoping slide assembly of claim 3, wherein the conical surface includes an outer conical portion situated in the body portion and an inner conical portion situated in the head portion and arranged to lie between the aperture means and the outer conical portion.

5. The telescoping slide assembly of claim 3, wherein the locking aperture formed in the intermediate slide member has a circular boundary, the body portion has a cylindrical shape and a first diameter, and the head portion has a cylindrical shape, a second diameter greater than the first diameter, and an annular side wall engaging the bottom side of the bottom wall.

6. The telescoping slide assembly of claim 1, wherein the load-carrying slide member includes a bottom wall formed to include the locking aperture, a pair of spaced-apart side walls appended to the bottom wall, and a top wall appended to the side walls and arranged to overlie the bottom wall to define an interior region therebetween, the locking means is attached to the load-carrying slide member and arranged to lie in the interior region, the bushing is arranged to lie outside of the interior region of the load-carrying slide member, and the bottom wall is positioned to lie between the top wall and the bushing.

7. The telescoping slide assembly of claim 6, wherein the inclined locking pin-camming ramp is mounted to the bottom wall and oriented to face toward the top wall and communicate with the interior region of the load-carrying slide member.

8. The telescoping slide assembly of claim 6, wherein the locking means further includes actuator means for moving the locking pin against the biasing means to a first position withdrawn from the locking aperture formed in the stationary slide member and to a second position withdrawn from the locking apertures formed in the stationary and intermediate slide members, the biasing means includes a base attached to the top wall of the load-carrying slide member and arranged to lie in the interior region and a compression spring having a top end engaging the base and a bottom end engaging the actuator means, and the bushing is arranged to orient the inclined locking pin-camming ramp in a position facing toward the compression spring upon movement of the load-carrying slide member to its fully retracted position.

9. The telescoping slide assembly of claim 1, wherein the intermediate slide member includes a pair of opposite ends and a second locking aperture formed in one of the opposite ends, and further comprising a second bushing mounted in the second locking aperture.

10. The telescoping slide assembly of claim 9, wherein the second bushing is formed to include opening means for slidably receiving the locking pin during movement of the load-carrying slide member toward its fully extended position and a second inclined locking pin-camming ramp communicating with the opening means and facing toward the load-carrying member.

11. The telescoping slide assembly of claim 10, wherein the bushing includes a second conical surface defining the second inclined locking pin-camming ramp.

12. A telescoping slide assembly comprising interconnected load-carrying, intermediate, and stationary slide members movable relative to one another to extend and retract the load-carrying and intermediate slide members relative to the stationary slide member between fully extended and retracted positions, each slide member being formed to include a locking aperture, means for locking the load-carrying slide and intermediate slide members to the stationary slide member upon movement of the load-carrying and intermediate slide members to their fully retracted positions, the locking means including a locking pin, means for yieldably biasing the locking pin to a slide-locking position passing simultaneously through the locking aperture formed in each slide member upon movement of the load-carrying and intermediate slide members to their fully retracted positions so that the load-carrying and intermediate slide members are retained in their fully retracted positions, and actuator means for selectively moving the locking pin against the biasing means selectively to a first position withdrawn from the locking aperture formed in the stationary slide member to permit movement of the load-carrying and intermediate slide members relative to the stationary slide member and to a second position withdrawn from the locking apertures formed in the intermediate and stationary slide members to permit movement of the interconnected load-carrying, intermediate, and stationary slide members relative to one another, and ramp means in the locking aperture formed in the intermediate slide member for automatically camming the locking pin from the first position to the second position during movement of the intermediate slide member relative to the stationary slide member in a first direction toward its fully extended position without operating the actuator means so that the load-carrying slide member is free to move relative to the intermediate slide member in the first direction toward its fully extended position.

13. The telescoping slide assembly of claim 12, further comprising a bushing mounted in the locking aperture formed in the intermediate slide member, the bushing being formed to include the ramp means.

14. The telescoping slide assembly of claim 13, wherein the bushing includes a conical surface defining the inclined locking pin-camming ramp.

15. The telescoping slide assembly of claim 12, wherein the actuator means includes a lever having a grip end lying adjacent to the load-carrying slide member and an actuator end engaging the locking pin and means for mounting the lever for pivotable movement relative to the load-carrying slide member so that the locking pin is movable from its slide-locking position to its first and second positions in response to pivoting movement of the lever.

16. The telescoping slide assembly of claim 15, wherein the ramp means is positioned to face toward the actuator end of the lever upon movement of the locking pin to its first position.

17. The telescoping slide assembly of claim 12, wherein the intermediate slide member includes a pair of opposite ends and a second locking aperture formed in one of the opposite ends, and further comprising cam means in the second locking aperture formed in the intermediate slide member for automatically camming the locking pin from the first position to the second position during movement of the intermediate slide member relative to the stationary slide member in a second direction toward its fully retracted position and opposite to the first direction without operating the actuator means so that the load-carrying slide member is free to move in the second direction toward its fully retracted position.

18. The telescoping slide assembly of claim 17, further comprising a second bushing mounted in the second locking aperture formed in the intermediate slide member, the second bushing being formed to include the cam means.

19. The telescoping slide assembly of claim 18, wherein the second bushing includes a conical surface defining the cam means.

20. A telescoping slide assembly comprising interconnected load-carrying, intermediate, and stationary slide members movable relative to one another to extend and retract the load-carrying and intermediate slide members relative to the stationary slide member between fully extended and retracted positions, each of the load-carrying and intermediate slide members being formed to include a first locking aperture, means for locking the load-carrying slide member to the intermediate slide member, the locking means including a locking pin, means for yieldably biasing the locking pin to a slide-locking position passing through the first locking apertures formed in the load-carrying and intermediate slide members, and actuator means for selectively moving the locking pin against the biasing means from a first position extending into the first locking aperture formed in the intermediate slide member to a second position withdrawn from the first locking aperture formed in the intermediate slide member, and cam means in the first locking aperture formed in the intermediate slide member for automatically camming the locking pin from the first position to the second position during movement of the load-carrying slide member relative to the stationary slide member toward its fully retracted position without operating the actuator means so that the load-carrying slide member is free to move relative to the intermediate slide member toward its fully retracted position.

21. The telescoping slide assembly of claim 20, further comprising a first bushing mounted in the first locking aperture formed in the intermediate slide member, the first bushing being formed to include the cam means.

22. The telescoping slide assembly of claim 21, wherein the first bushing includes a conical surface defining the cam means.

23. The telescoping slide assembly of claim 21, wherein the stationary slide member includes a leading end formed to include a beveled edge arranged to engage the locking pin during movement of the intermediate slide member toward its fully retracted position and the first bushing is arranged to lie adjacent to the beveled edge upon movement of the intermediate slide member to its fully retracted position.

24. The telescoping slide assembly of claim 23, wherein the stationary slide member is formed to include a first locking aperture and the intermediate slide member is formed to include a second locking aperture situated to lie in spaced-apart relation to the first locking aperture formed in the intermediate slide member, and further comprising a second bushing mounted in the second locking aperture formed in the intermediate slide means, the second bushing being formed to include aperture means for slidably receiving the locking pin and guiding the locking pin into the first locking aperture formed in the stationary slide member upon movement of the intermediate slide member to its fully retracted position and an inclined locking pin-camping ramp communicating with the aperture means and facing toward the load-carrying slide member.

25. The telescoping slide assembly of claim 20, wherein the stationary slide member is formed to include a first locking aperture and the intermediate slide member is formed to include a second locking aperture situated to lie in spaced-apart relation to the first locking aperture formed in the intermediate slide member, and further comprising ramp means in the second locking aperture formed in the intermediate slide member for automatically camming the locking pin from the first position to the second position during movement of the intermediate slide member relative to the stationary slide member toward its fully extended position without operating the actuator means so that the load-carrying slide member is free to move relative to the intermediate slide member toward its fully extended position.

26. The telescoping slide assembly of claim 25, further comprising a first bushing mounted in the first locking aperture formed in the intermediate slide member and wherein the first bushing is formed to include the cam means and the second bushing is formed to include the ramp means.

27. The telescoping slide assembly of claim 26, wherein the first bushing includes a conical surface defining the cam means.

28. The telescoping slide assembly of claim 26, wherein the second bushing includes a conical surface defining the ramp means.

29. A telescoping slide assembly comprising interconnected load-carrying, intermediate, and stationary slide members movable relative to one another to extend and retract the load-carrying and intermediate slide members relative to the stationary slide member between fully extended and retracted positions, the stationary slide member being formed to include a stationary locking aperture, the load-carrying slide member being formed to include a mobile locking aperture, and the intermediate slide member being formed to include spaced-apart first and second locking apertures, means for locking the load-carrying slide member to the intermediate slide member, the locking means including a locking pin, and a first bushing mounted in the first locking aperture formed in the intermediate slide member and a second bushing mounted in the second locking aperture formed in the intermediate slide member, the first bushing being formed to include an elongated first funnel-shaped passage having a small opening at one end facing toward the stationary slide member and a large opening at an opposite end facing toward the load-carrying slide member, the second bushing being formed to include an elongated second funnel-shaped passage having a small opening at one end facing toward the stationary slide member and a large opening at an opposite end facing toward the load-carrying slide member.

30. The telescoping slide assembly of claim 29, wherein the stationary slide member includes a leading end formed to include a beveled edge defining means for engaging the locking pin during movement of the intermediate slide member toward its fully retracted position and a trailing end carrying stop means for engaging the intermediate slide member to establish the fully retracted position, the first bushing is positioned to lie adjacent to the beveled edge of the stationary slide member upon engagement of the intermediate slide member and the stop means, and the second bushing is positioned to lie midway between the leading and trailing ends of the stationary slide member upon engagement of the intermediate slide member and the stop means.

* * * * *